US010294645B2

(12) United States Patent
Kawada et al.

(10) Patent No.: US 10,294,645 B2
(45) Date of Patent: May 21, 2019

(54) SANITARY WASHING DEVICE

(71) Applicant: TOTO LTD., Kitakyushu-shi, Fukuoka (JP)

(72) Inventors: Satoshi Kawada, Kitakyushu (JP); Yasuhiro Matsuda, Kitakyushu (JP); Takeshi Yamakawa, Kitakyushu (JP)

(73) Assignee: TOTO LTD., Kitakyushu-Shi, Fukuoka (JP)

( * ) Notice: Subject to any disclaimer, the term of this patent is extended or adjusted under 35 U.S.C. 154(b) by 0 days.

(21) Appl. No.: 15/672,676

(22) Filed: Aug. 9, 2017

(65) Prior Publication Data

US 2018/0058055 A1 Mar. 1, 2018

(30) Foreign Application Priority Data

Aug. 25, 2016 (JP) ..... 2016-164625

(51) Int. Cl.

| | |
|---|---|
| ***A47K 3/022*** | (2006.01) |
| ***E03D 9/08*** | (2006.01) |
| ***A47K 4/00*** | (2006.01) |
| ***F24H 1/00*** | (2006.01) |
| ***F24H 1/10*** | (2006.01) |
| ***F24H 9/20*** | (2006.01) |
| ***H05B 1/02*** | (2006.01) |

(52) U.S. Cl.

CPC ..... *E03D 9/08* (2013.01); *A47K 4/00* (2013.01); *F24H 1/0018* (2013.01); *F24H 1/0072* (2013.01); *F24H 1/101* (2013.01); *F24H 9/2014* (2013.01); *H05B 1/0283* (2013.01)

(58) Field of Classification Search

CPC ..... E03D 9/08; A47K 4/00; F24H 1/0018
USPC ..... 4/420.1
See application file for complete search history.

(56) References Cited

U.S. PATENT DOCUMENTS

| | | | | |
|---|---|---|---|---|
| 6,327,718 | B1 * | 12/2001 | Ono | E03D 9/08 4/420.2 |
| 6,430,366 | B1 * | 8/2002 | Mizutani | E03D 9/08 392/449 |
| 2010/0095443 | A1 | 4/2010 | Nishimura et al. | |
| 2011/0061608 | A1 | 3/2011 | Kim et al. | |
| 2013/0117920 | A1 | 5/2013 | Nishimura et al. | |

FOREIGN PATENT DOCUMENTS

| | | | |
|---|---|---|---|
| DE | 35 41 091 | A1 | 5/1986 |
| JP | 2015-067941 | A | 4/2015 |
| JP | 2015-069693 | A | 4/2015 |

* cited by examiner

*Primary Examiner* — Huyen Le
(74) *Attorney, Agent, or Firm* — Pearne & Gordon LLP

(57) ABSTRACT

There is provided a sanitary washing device. The sanitary washing device includes a wash water heating part, a jetting nozzle, and a controller. The wash water heating part includes a first heater and a second heater. A resistance value of the second heater is higher than a resistance value of the first heater. The wash water heating part heats wash water supplied from a water supply source by only the first heater and the second heater. The jetting nozzle jets the wash water supplied via the wash water heating part. The controller controls a power supplied to the first heater and the second heater.

6 Claims, 4 Drawing Sheets

0 ~ 350(W)

350 ~ 850(W)

850 ~ 1200(W)

SANITARY WASHING DEVICE

CROSS-REFERENCE TO RELATED APPLICATIONS

This application is based upon and claims the benefit of priority from Japanese Patent Application No. 2016-164625, filed on Aug. 25, 2016; the entire contents of which are incorporated herein by reference.

FIELD

Embodiments described herein relate generally to a sanitary washing device.

BACKGROUND

A sanitary washing device has been known, which washes a human body private part by squirting wash water. The sanitary washing device includes a wash water heating part which heats the wash water, and makes it possible to squirt warm water to the human body private part.

In such a sanitary washing device, it has been performed to provide three or more heaters having the same resistance value on the wash water heating part and control energization to the respective heaters separately (for example, JP 2015-69693 A (Kokai)). This allows the washing water temperature to be controlled more finely compared with the case of providing one heater having a large output.

However, if a large number of heaters are provided on the wash water heating part, the number of electric wires and switches or the like for controlling the energization increases with increasing number of the heater, and the increase in the size and cost of the wash water heating part accompanying with the increase of parts count are caused. Therefore, it is desired for the sanitary washing device to make it possible to control finely the wash water temperature while suppressing the increase in the size and cost.

SUMMARY

According to an aspect of the invention, there is provided a sanitary washing device. The sanitary washing device includes a wash water heating part, a jetting nozzle, and a controller. The wash water heating part includes a first heater and a second heater. A resistance value of the second heater is higher than a resistance value of the first heater. The wash water heating part heats wash water supplied from a water supply source by only the first heater and the second heater. The jetting nozzle jets the wash water supplied via the wash water heating part. The controller controls a power supplied to the first heater and the second heater.

DETAILED DESCRIPTION

Figure 1:
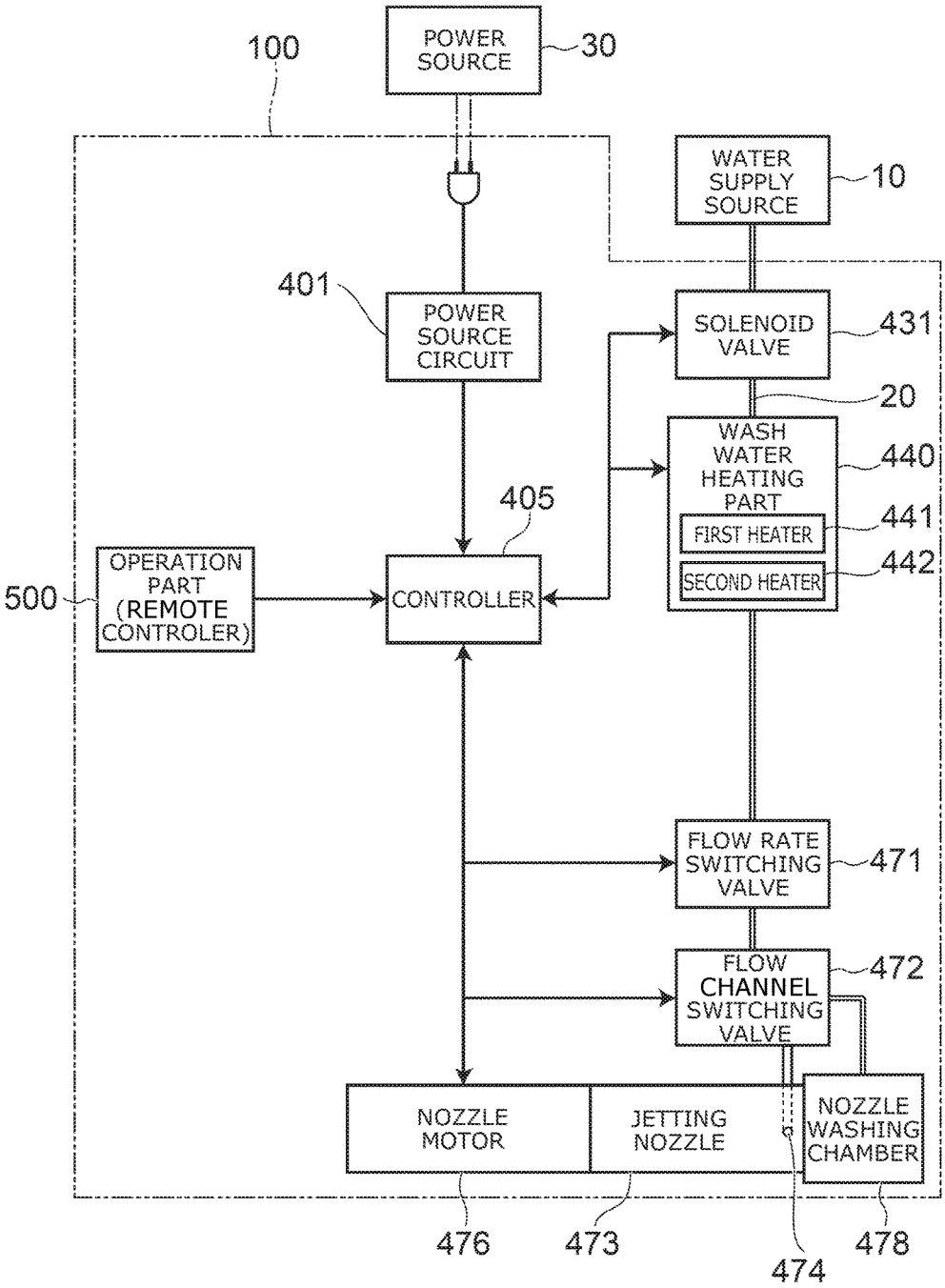
FIG. 1 is a block diagram showing the relevant configuration of a sanitary washing device according to an embodiment.

The first invention relates to a sanitary washing device. The sanitary washing device includes a wash water heating part, a jetting nozzle, and a controller. The wash water heating part includes a first heater and a second heater. A resistance value of the second heater is higher than a resistance value of the first heater. The wash water heating part heats wash water supplied from a water supply source by only the first heater and the second heater. The jetting nozzle jets the wash water supplied via the wash water heating part. The controller controls a power supplied to the first heater and the second heater.

According to the sanitary washing device, the temperature of the wash water can be controlled finely as well as the case where three or more heaters having the same resistance value are provided, and the increase in the size and cost of the wash water heating device can be suppressed compared with the case where three or more heaters having the same resistance value are provided. Therefore, the temperature of the wash water can be controlled finely, and the small size sanitary washing device can be provided.

The second invention relates to the sanitary washing device of the first invention, and the controller executes a switching control of energization and non-energization to each of the first heater and the second heater.

According to the sanitary washing device, the temperature of the wash water can be controlled more finely.

The third invention relates to the sanitary washing device of the first invention or the second invention, and the controller executes a pattern control simultaneously to the first heater and the second heater.

According to the sanitary washing device, the temperature of the wash water can be controlled more finely.

The fourth invention relates to the sanitary washing device of one of the first to third inventions, and the controller executes an energization control controlling a total power supplied by switching of energization and non-energization simultaneously to each of the first heater and the second heater.

According to the sanitary washing device, the temperature of the wash water can be further controlled finely.

The fifth invention relates to the sanitary washing device of the fourth invention, and the controller executes the energization control simultaneously to each of the first heater and the second heater, when a required output is greater than a rated capacity of the second heater and not more than a rated capacity of the first heater.

According to the sanitary washing device, the fluctuation of the power can be controlled adequately while enabling the temperature of the wash water to control finely.

The sixth invention relates to the sanitary washing device of the fourth or fifth invention, and a period of a power fluctuation between the energization and the non-energization of the first heater and the second heater is a power fluctuation of not more than the power difference between the first heater and the second heater.

According to the sanitary washing device, the fluctuation of the power can be suppressed more. The occurrence of the flickering in the lighting device can be suppressed more.

The seventh invention relates to the sanitary washing device of one of the first to sixth inventions, and the resistance value of the second heater is not less than 2 times and not more than 2.5 times the resistance value of the first heater.

Various embodiments of the invention will be described hereinafter with reference to the accompanying drawings. In the figures, the same reference numbers are applied to the same constitutional elements, and detailed description will not be repeated as appropriate.

FIG. 1 is a block diagram showing the relevant configuration of a sanitary washing device according to an embodiment.

As shown in FIG. 1, a sanitary washing device 100 includes a wash water heating part 440, a jetting nozzle 473, and a controller 405. In FIG. 1, the relevant configuration of a water channel system of the sanitary washing device 100 is shown together with the relevant configuration of an electric system.

The wash water heating part 440 includes a first heater 441 and a second heater 442. A resistance value of the second heater 442 is higher than a resistance value of the first heater 441. The wash water heating part 440 heats the wash water supplied from a water supply source 10 only by the first heater 441 and the second heater 442.

A jetting nozzle 473 includes a jetting port 474 provided at a distal end portion. The jetting nozzle 473 jets the wash water supplied through the wash water heating part 440 from the jetting port 474 to wash a body (for example, "bottom" or the like) of a user seating on a toilet seat not illustrated, for example.

For example, as shown in FIG. 1, the sanitary washing device 100 according to the embodiment includes a flow channel 20 introducing the water supplied from the water supply source 10 such as a water supply or a water storage tank to the jetting port 474 of the jetting nozzle 473. A solenoid valve 431 is provided on an upstream side of the flow channel 20. The solenoid valve 431 is a solenoid valve capable of opening/closing, and controls the water supply on the basis of the command from the controller 405. That is, the solenoid valve 431 switches the water supply and the water stop of the water supplied from the water supply source 10 to the jetting nozzle 473.

The wash water heating part 440 is provided on the downstream of the solenoid valve 431. The wash water heating part 440 heats the water supplied from the water supply source 10 by the first heater 441 and the second heater 442 to increase till a prescribed temperature, for example. The wash water heating part 440 converts the water supplied from the water supply source 10 to the warm water having the prescribed temperature.

The wash water heating part 440 according to the embodiment is a heat exchanger of an instantaneous heating type (instantaneous type) using a cylindrical ceramic heater or the like. The first heater 441 and the second heater 442 are heater patterns provided on the ceramic heater. The user can set a warm water temperature by operating an operation part 500.

A flow rate switching valve 471 adjusting a flow rate and a flow channel switching valve 472 are provided on the downstream of the wash water heating part 440. The flow channel switching valve 472 performs opening/closing of water supply to the jetting nozzle 473 and a nozzle washing chamber 478, and switches a water supply destination. The flow rate switching valve 471 adjusts a flow rate of water flowing through the jetting nozzle 473. The flow channel switching valve 472 can switch the water supply destination (destination of flow channel connection) to one of the jetting nozzle 473 and the nozzle washing chamber 478. The flow rate switching valve 471 and the flow channel switching valve 472 may be provided as one unit.

The jetting nozzle 473 is provided on the downstream of the flow rate switching valve 471 and the flow channel switching valve 472. The jetting nozzle 473 receives a driving force from a nozzle motor 476, and can advance into a bowl of the toilet seat and retract into a casing. That is, the nozzle motor 476 can cause the jetting nozzle 473 to advance/retract on the basis of the command from the controller 405.

The nozzle washing chamber 478 can sterilize or wash a outer peripheral surface (trunk) of the jetting nozzle 473 by squirting a sterilized water or the water from a not illustrated water discharger provided inside the nozzle washing chamber 478. Alternatively, the nozzle washing chamber 478 can sterilize or wash a portion of the jetting port 474 of the jetting nozzle 473 in a stored state.

The controller 405 is supplied with electric power from a power source 30 via a power source circuit 401, and can control operations of the solenoid valve 431, the wash water heating part 440, the flow rate switching valve 471, the flow channel switching valve 472, and the nozzle motor 476 on the basis of the command from the operation part 500 or the like. For example, the controller 405 controls the electric power supplied to the first heater 441 and the second heater 442 of the wash water heating part 440 from the power source 30.

The power source 30 is, for example, an AC power source. The power source 30 is, for example, a commercial power source with AC 100V (effective value). The power source circuit 401 converts AC power supplied from the power source 30 to DC power, and supplies the DC power after the conversion to the controller 405. On the other hand, the power source circuit 401 supplies the AC power to the first heater 441 and the second heater 442 of the wash water heating part 440.

Figure 2:
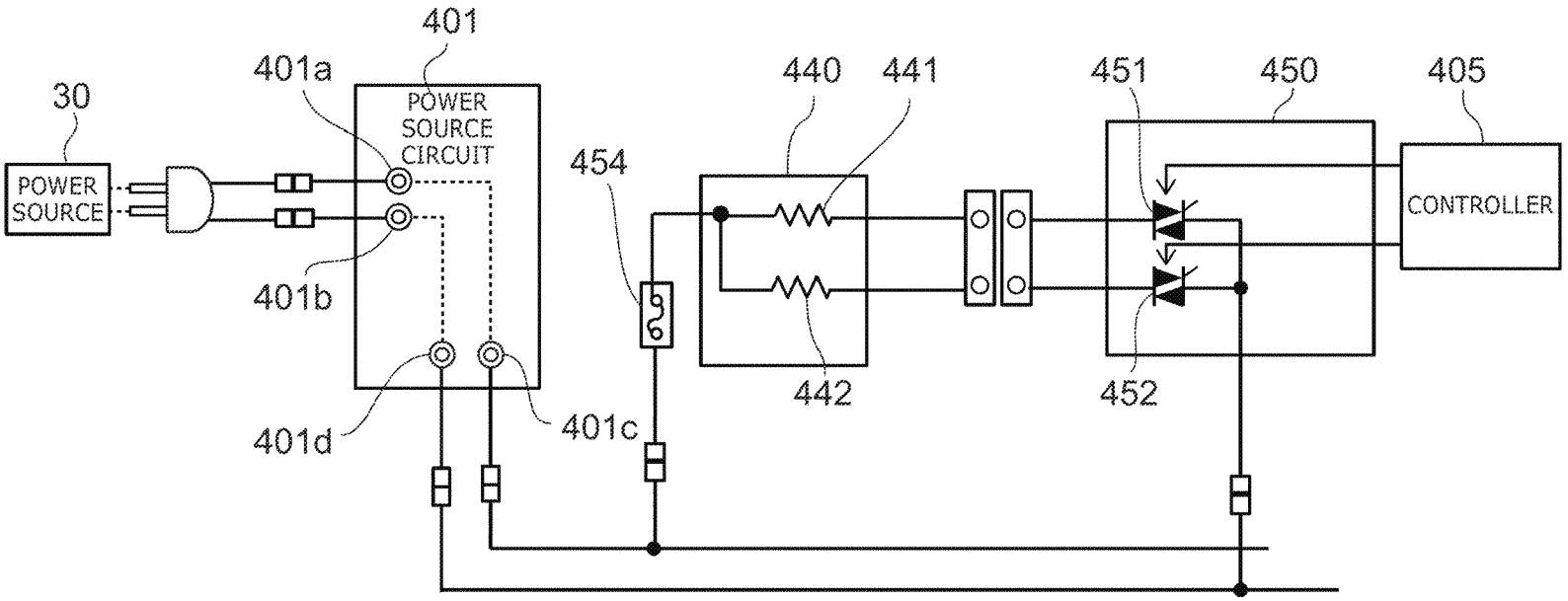
FIG. 2 is a circuit diagram showing a portion of the sanitary washing device according to the embodiment.

FIG. 2 is a circuit diagram showing a portion of the sanitary washing device according to the embodiment.

As shown in FIG. 2, the power source circuit 401 includes a pair of input terminals 401*a*, 401*b*, and a pair of output terminals 401*c*, 401*d*. The power source circuit 401 outputs, for example, the AC power inputted from the input terminals 401*a*, 401*b* from the output terminals 401*c*, 401*d* as it is. The power source circuit 401 performs voltage conversion or the like, for example, and may output the AC power after the conversion from the output terminals 401*c*, 401*d*.

The sanitary washing device 100 further includes a control substrate 450 and a temperature fuse 454. The control substrate 450 includes a first switching element 451 and a second switching element 452. The control substrate 450 and the temperature fuse 454 may be provided on the wash water heating part 440, and may be provided separately from the wash water heating part 440.

The first switching element 451 and the second switching element 452 include, for example, a pair of main terminals and control terminals, and switches on/off of a current flowing between the pair of main terminals by a signal inputted to the control terminals. A triac is used for the first switching element 451 and the second switching element 452, for example. The first switching element 451 and the second switching element 452 may be an arbitrary element capable of controlling on/off of the current and capable of flowing the current bidirectionally. For example, the first switching element 451 and the second switching element 452 may be a mechanical type relay and may be configured to combine multiple semiconductor switches or the like.

The first switching element 451 and the second switching element 452 generate heat, for example, by flowing the current between the pair of terminals. The first heater 441 and the second heater 442 are, for example, a resistor.

The rated capacity of the wash water heating part 440 is determined as a sum of the rated capacity of the first heater 441 and the rated capacity of the second heater 442. The rated capacity of the wash water heating part 440 is, for example, 1200 W. In such a case, the rated capacity of the second heater 442 is, for example, not less than 350 W and not more than 400 W. The rated capacity of the first heater 441 is, for example, not less than 800 W and not more than 850 W. In this manner, the rated capacities of the first heater 441 and the second heater 442 are set to be about 1:2. The resistance value of the second heater 442 is set to be, for example, not less than 2 times and not more than 2.5 times the resistance value of the first heater 441. This can suppress, for example, the increase of a breakdown voltage of the first switching element 451. For example, substantially the same element can be used for the first switching element 451 and the second switching element 452.

One end of the temperature fuse 454 is connected to the output terminal 401*c* of the power source circuit 401. Other end of the temperature fuse 454 is connected to one end of the first heater 441 and one end of the second heater 442. In this manner, the first heater 441 and the second heater 442 are connected to the output terminal 401*c* of the power source circuit 401 via the temperature fuse 454. The first heater 441 and the second heater 442 are connected in parallel to the output terminal 401*c* of the power source circuit 401.

In the case where the temperature of the wash water heating part 440 is not less than a prescribed temperature, the temperature fuse 454 opens paths between the power source circuit 401 and the respective heaters 441, 442, and blocks supply of power to the respective heaters 441, 442. Thereby, the temperature fuse 454 suppresses the wash water heating part 440 from generating heat not less than the prescribed temperature. The temperature fuse 454 suppresses, for example, no-water heating of the wash water heating part 440.

Other end of the first heater 441 is connected to one main terminal of the first switching element 451. Other end of the second heater 442 is connected to one main terminal of the second switching element 452.

Other main terminal of the first switching element 451 is connected to the output terminal 401*d* of the power source circuit 401. Other main terminal of the second switching element 452 is connected to the output terminal 401*d* of the power source circuit 401.

Thereby, if the first switching element 451 is turned on, a current flows through the first heater 441, and the first heater 441 generates heat. Similarly, if the second switching element 452 is turned on, a current flows through the second heater 442, and the second heater 442 generates heat.

The respective control terminals of the first switching element 451 and the second switching element 452 are connected to the controller 405. The controller 405 controls on/off of the first switching element 451 and the second switching element 452. In the case where the triac is used for the first switching element 451 and the second switching element 452, more specifically, the controller 405 controls the on timing of the first switching element 451 and the second switching element 452. The controller 405 controls the supply of power to the first heater 441 and the second heater 442 separately based on on/off of the first switching element 451 and the second switching element 452.

Figure 3:
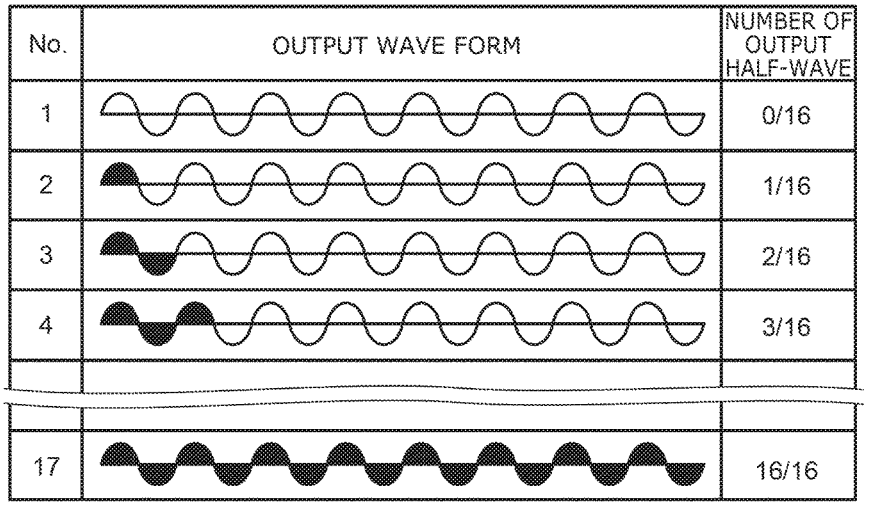
FIG. 3 is a description view showing one example of the operation of a controller of the sanitary washing device according to the embodiment.

FIG. 3 is a description view showing one example of the operation of a controller of the sanitary washing device according to the embodiment.

The controller 405 performs an energization control controlling a total power supplied by switching of energization and non-energization to the first heater 441 and the second heater 442. The controller 405, as shown in FIG. 3, performs, for example, the energization control in a pattern control method having 16 half waves as one unit.

"The pattern control method" is a method of controlling the total power, in which a half-wave to a sine wave of the power source 30 is set to be one unit, the energization and non-energization to the first heater 441 and the second heater 442 are controlled in units of half-wave, and the half-wave unit is combined multiply.

In the case where the first heater 441 and the second heater 442 are not energized, the controller 405 selects an energization pattern having the number of output half-wave of 0/16. In the case where the first heater 441 and the second heater 442 are energized, and the total power is increased, the controller 405 selects energization patterns having the number of output half-wave (number of outputting half-wave) of 1/16, 2/16, 3/16, . . . , 16/16 depending on required heat quantity. Thereby, the temperature of the wash water of the wash water heating part 440 can be controlled finely.

In FIG. 3, portions painted in black show half-waves outputting to the first heater 441 and the second heater 442. In FIG. 3, when the number of output half-wave is 2/16 and 3/16, outputting half-waves are continual, however outputting half-waves may be disposed with a prescribed interval.

The number of half-waves forming one unit is not limited to 16 in the pattern control method, and may be arbitrary. The energization control performed to the first heater 441 and the second heater 442 is not limited to the pattern control method, and may be, for example, a phase control method or the like. "The phase control method" is a method controlling an energization angle depending on the required heat quantity.

In the second heater 442 having a higher resistance value than the first heater 441, the pattern control may be executed to the first heater 441 and the phase control may be executed to the second heater 442. In the case of controlling from the energization angle having the high required heat quantity to the energization angle having the low heat quantity in the phase control, power source fluctuation increases and thus a power source noise is generated. In the phase control of providing a resistance values difference and being only on a high resistance value side, a power capacity is small, and thus the power source fluctuation is small and the power source noise is not likely to be generated.

FIG. 4A to FIG. 4H are graph views showing one example of the operation of the controller of the sanitary washing device according to the embodiment.

Figure 4A:
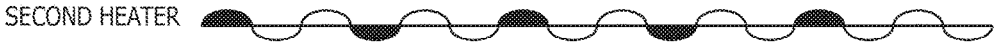
FIG. 4A to FIG. 4H are graph views showing one example of the operation of the controller of the sanitary washing device according to the embodiment.

FIG. 4A shows one example of the pattern control of the second heater 442 in a low output zone.

Figure 4B:
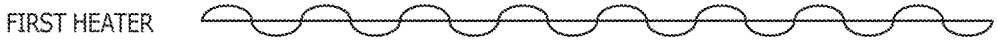

FIG. 4B shows one example of the pattern control of the first heater 441 in the low output zone.

Figure 4C:
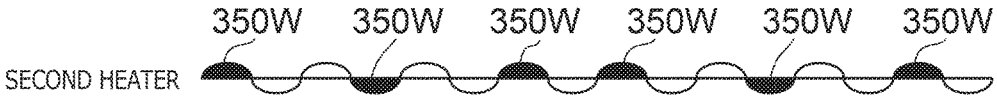

FIG. 4C shows one example of the pattern control of the second heater 442 in a middle output zone.

Figure 4D:
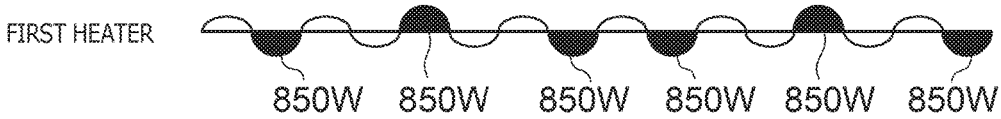

FIG. 4D shows one example of the pattern control of the first heater 441 in the middle output zone.

Figure 4E:
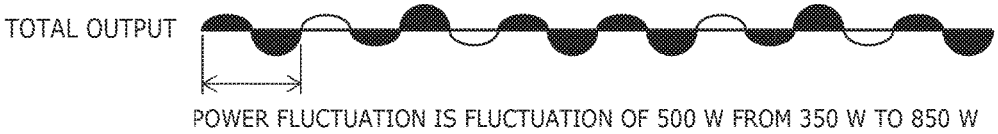

FIG. 4E shows one example of a total output of the first heater 441 and the second heater 442 in the middle output zone.

Figure 4F:
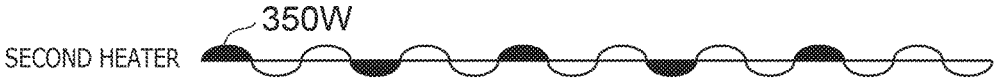

FIG. 4F shows one example of the pattern control of the second heater 442 in a high output zone.

Figure 4G:
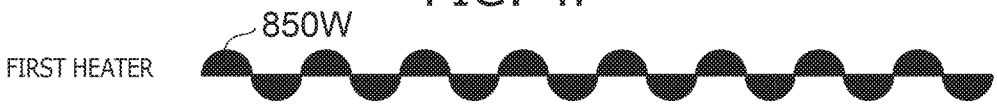

FIG. 4G shows one example of the pattern control of the first heater 441 in the high output zone.

Figure 4H:
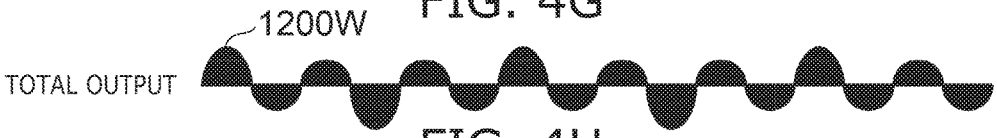

FIG. 4H shows one example of the pattern control of a total output of the first heater 441 and the second heater 442 in the high output zone.

Here, in the low output zone is, for example, the required output is within a range of not more than the rated capacity of the second heater 442. In the middle output zone, for example, the required output is within a range of greater than the rated capacity of the second heater 442 and not more than the rated capacity of the first heater 441. In the high output zone, for example, the required output is within a range of greater than the rated capacity of the first heater 441 and not more than the total capacity of the rated capacity of the first heater 441 and the rated capacity of the second heater 442. The low output zone is, for example, a range of not more than 350 W. The middle output zone is a range of greater than 350 W and not more than 850 W. The high output zone is a range of greater than 850 W and not more than 1200 W.

As shown in FIG. 4A and FIG. 4B, in the low output zone, the controller 405 sets the first heater 441 to full off (energization pattern of 0/16), and executes the pattern control only to the second heater 442. In such a case, the total output (output of wash water heating part 440) of the first heater 441 and the second heater 442 is substantially the same as the output of the second heater 442.

As shown in FIG. 4C to FIG. 4E, in the middle output zone, the controller 405 executes the pattern control simultaneously to each of the first heater 441 and the second heater 442.

As shown in FIG. 4F to FIG. 4H, in the high output zone, the controller 405 sets the first heater 441 to full on (energization pattern of 16/16), and executes the pattern control only to the second heater 442. Thereby, the output of the wash water heating part 440 can be controlled finely in the range from the low output zone to the high output zone. That is, the temperature of the wash water can be controlled finely.

The energization control of the pattern control method includes unavailable number of output half-wave. In the case of unavailable number of output half-wave, the fluctuation of power becomes relatively large due to switching between the energization and the non-energization. Therefore, if the pattern control is performed with the unavailable number of output half-wave, for example, flickering may occur in the lighting device commonly connected to the power source 30 with the sanitary washing device 100.

Therefore, the controller 405 performs the pattern control of the first heater 441 and the second heater 442 using previously determined available number of output half-wave. Thereby, the fluctuation of the power cane suppressed while controlling finely the temperature of the wash water. For example, the flickering can be suppressed from occurring in the lighting device.

There is a correlation between the unavailable number of output half-wave and the rated capacity of the heater, and as the rated capacity of the heater increases, the unavailable number of output half-wave increases. Therefore, in the sanitary washing device 100, the resistance value of the first heater 441 is set to be lower than the resistance value of the second heater 442. Thereby, when the temperature control is performed by two heaters 441, 442, resolution of the temperature control can be higher than the case of setting the rated capacities of the two heaters 441, 442 to be the same.

For example, when the rated capacities of the respective heaters 441, 442 are 600 W, the output per one half-wave is 37.5 W. On the other hand, when the rated capacity of the second heater 442 is 350 W and the rated capacity of the first heater 441 is 850 W, the output per one half-wave of the second heater 442 is 21.875 W. In this manner, by causing the rated capacities of the two heaters 441, 442 to be different, the resolution of the temperature control can be higher and the temperature of the wash water can be controlled more finely.

For example, in the case of providing three 400 W heaters, the output per one heater is 25 W. Therefore, in the case of setting the rated capacity of the second heater 442 to be 350 W, even if the number of heaters is only two, it is possible to obtain the resolution equal or higher than that obtained when three or more heaters are provided.

In the sanitary washing device 100, the resistance value of the first heater 441 and the resistance value of the second heater 442 are set to be about 1:2. Thereby, the rated capacity of the first heater 441 can be suppressed from being excessively large. The unavailable number of output half-wave can be suppressed from increasing in the first heater 441. The available number of output half-wave in the first heater 441 and the available number of output half-wave in the second heater 442 are balanced, and thus the temperature controllability of the wash water can be higher. Furthermore, as described previously, it is possible to suppress increasing of the breakdown voltage of the first switching element 451, and to use substantially the same element for the first switching element 451 and the second switching element 452. For example, increasing in size of the second switching element 452 and cost increase or the like can be suppressed.

In the case of executing the pattern control simultaneously to each of the first heater 441 and the second heater 442 in the middle output zone, as shown in FIG. 4C to FIG. 4E, the controller 405 supplies the power to the first heater 441 at a half-wave subsequent to a half-wave at which the power is supplied to the second heater 442. That is, the controller 405 executes the energization control so that a period of a power fluctuation between the energization and the non-energization of the first heater 441 and the second heater 442 is a power fluctuation of not more than the power difference between the first heater 441 and the second heater 442. In this example, the power fluctuation when the power is supplied to the first heater 441 can be suppressed to be fluctuation of 500 W from 350 W to 850 W. This can suppress a fluctuation width of the currents of the first heater 441 and the second heater 442 flowing through the wash water heating part 440 when supplying the power to the first heater 441. The voltage fluctuation of the power source 30 and the occurrence of the flickering of the lighting device connected to the power source 30 or the like can be suppressed.

As described above, in the sanitary washing device 100 according to the embodiment, also in the case where the number of heaters is only two, the temperature of the wash water can be controlled finely as well as the case where three or more heaters having the same resistance value are provided, and increasing in size of the wash water heating device 440 and cost increase can be suppressed compared with the case where three or more heaters having the same resistance value are provided.

The controller 405 executes the control switching energization and non-energization to each of the first heater 441 and the second heater 442. This allows the temperature of the wash water to be controlled more finely.

The controller 405 executes the pattern control simultaneously to the first heater 441 and the second heater 442. This allows the temperature of the wash water to be controlled more finely.

The number or the like of switching elements switching energization and non-energization of the heater can be reduced as well. A radiator such as a heat sink made of metal is required to be provided on the switching element as a heat generator. The radiator like this can be reduced as well by reducing the switching element. In this manner, setting the number of heaters to only two contributes largely to downsizing and cost reduction of the sanitary washing device 100. Therefore, the temperature of the wash water can be controlled finely and the small size sanitary washing device 100 can be provided.

In the sanitary washing device 100, the energization control is executed simultaneously to each of the first heater 441 and the second heater 442. This allows the temperature of the wash water to be controlled more finely. This allows the fluctuation of the power accompanied with energization and non-energization of the heater 441 and the heater 442 to be suppressed. For example, the occurrence of the flickering of the lighting device accompanied with energization to the second heater 442 can be suppressed.

In the sanitary washing device 100, in the middle output zone, the energization control is executed simultaneously to each of the first heater 441 and the second heater 442. This allows the fluctuation of the power to be controlled adequately while enabling the temperature of the wash water to control finely.

The controller 405 executes the energization control so that a period of a power fluctuation between the energization and the non-energization of the first heater 441 and the second heater 442 is a power fluctuation of not more than the power difference between the first heater 441 and the second heater 442. This allows the fluctuation of the power to be suppressed more. The occurrence of the flickering of the light device can be suppressed more.

In the sanitary washing device 100, the resistance value of the second heater 442 is set to be not less than 2 times and not more than 2.5 times the resistance value of the first heater 441. This allows the temperature of the wash water to be controlled finely with only the two first and second heaters 441, 442.

Although the embodiments of the invention are described above, the invention is not limited to these descriptions. Any design variation in the above embodiments appropriately made by a person skilled in the art is also encompassed within the scope of the invention as long as they fall within the spirit of the invention. For example, the shape, the size, the material, and the disposition or the like of the respective components included in the sanitary washing device 100 are not limited to illustrations and can be changed appropriately.

The components included in the embodiments described above can be combined to the extent of technical feasibility and the combinations are included in the scope of the invention to the extent that the feature of the embodiments is included.

What is claimed is:

1. A sanitary washing device comprising:

a wash water heating part including a first heater and a second heater, a resistance value of the second heater being higher than a resistance value of the first heater, the wash water heating part heating wash water supplied from a water supply source by only the first heater and the second heater;

a jetting nozzle jetting the wash water supplied via the wash water heating part; and a controller controlling a power supplied to the first heater and the second heater, the controller performing an energization control to the first heater in a first pattern control and performing an energization control to the second heater in a second pattern control, the controller controlling a total power supplied to the first heater and the second heater by the first pattern control and the second pattern control, the controller switching energization and non-energization to the first heater in the first pattern control based on a first energization pattern, the controller switching energization and non-energization to the second heater in the second pattern control based on a second energization pattern, and the controller setting a half-wave of a sine wave of a power source to a half-wave unit, the first energization pattern being configured to combine plurality of the half-wave unit, the second energization pattern being configured to combine plurality of the half-wave unit.

2. The sanitary washing device according to claim 1, wherein the controller executes the first pattern control and the second pattern control simultaneously to the first heater and the second heater.

3. The sanitary washing device according to claim 1, wherein the controller executes an energization control simultaneously to each of the first heater and the second heater, a total power supplied by switching of energization and non-energization being controlled in the energization control.

4. The sanitary washing device according to claim 3, wherein the controller executes the energization control simultaneously to each of the first heater and the second heater, when a required output is greater than a rated capacity of the second heater and not more than a rated capacity of the first heater.

5. The sanitary washing device according to claim 3, wherein the controller executes the energization control so that a period of a power fluctuation between the energization and the non-energization of the first heater and the second heater is a power fluctuation of not more than a power difference between the first heater and the second heater.

6. The sanitary washing device according to claim 1, wherein the resistance value of the second heater is not less than 2 times and not more than 2.5 times the resistance value of the first heater.

* * * * *